US010338500B2

(12) United States Patent
Usui

(10) Patent No.: US 10,338,500 B2
(45) Date of Patent: Jul. 2, 2019

(54) POWDER DETECTION DEVICE AND DEVELOPMENT DEVICE

(71) Applicant: Sharp Kabushiki Kaisha, Osaka (JP)

(72) Inventor: Tomoya Usui, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 16/010,475

(22) Filed: Jun. 17, 2018

(65) Prior Publication Data

US 2018/0299802 A1 Oct. 18, 2018

Related U.S. Application Data

(63) Continuation of application No. 15/482,171, filed on Apr. 7, 2017, now Pat. No. 10,025,224.

(30) Foreign Application Priority Data

Apr. 15, 2016 (JP) ..... 2016-081616

(51) Int. Cl.
*G03G 15/08* (2006.01)
*G03G 15/095* (2006.01)

(52) U.S. Cl.
CPC ..... *G03G 15/095* (2013.01); *G03G 15/0856* (2013.01); *G03G 15/0862* (2013.01); *G03G 2215/0897* (2013.01)

(58) Field of Classification Search
CPC ..... G03G 15/0831; G03G 15/0862; G03G 15/095; G03G 2215/0897; G03G 15/0856
USPC ..... 399/27, 71
See application file for complete search history.

(56) References Cited

U.S. PATENT DOCUMENTS 5,521,684 A * 5/1996 Takahashi ..... G03G 15/0862 118/694
8,995,851 B2 3/2015 Ikebata
2011/0222871 A1 9/2011 Suzuki
2016/0147181 A1 5/2016 Inoue

FOREIGN PATENT DOCUMENTS

EP 0665475 A2 8/1995
JP 6-16964 U 3/1994

OTHER PUBLICATIONS

Allowed claims from Parent U.S. Appl. No. 15/482,171, submitted Feb. 23, 2018.

* cited by examiner

*Primary Examiner* — Sophia S Chen
(74) *Attorney, Agent, or Firm* — Renner, Otto, Boisselle & Sklar, LLP

(57) ABSTRACT

A powder detection device includes a detection unit, a cleaning unit, and a drive unit. The detection unit includes detection surfaces provided in a storage container and enables detection of powder through the detection surfaces. The cleaning unit removes the powder from the detection surfaces by sliding along the detection surfaces. The drive unit reciprocates the cleaning unit along a path extending through the detection surfaces and differentiates a speed at which the cleaning unit is moved in a first direction along the path from a speed at which the cleaning unit is moved in a second direction opposite to the first direction.

17 Claims, 10 Drawing Sheets

POWDER DETECTION DEVICE AND DEVELOPMENT DEVICE

CROSS-REFERENCE TO RELATED APPLICATION

This is a continuation under 35 USC § 120 of U.S. application Ser. No. 15/482,171, filed on Apr. 7, 2017, the entire disclosure of which is hereby incorporated herein by reference.

BACKGROUND

1. Field

The present disclosure relates to a powder detection device that detects powder such as developer and a development device that includes such a powder detection device.

2. Description of the Related Art

In an electrophotographic image forming apparatus, an electrostatic latent image formed on a photosensitive drum is developed by developer supplied from a development device. Then the development device draws up the developer from a developer tank onto a development roller and delivers the developer to a developing position with rotation of the development roller. The developer is supplied from a detachable cartridge into the developer tank.

There has been a technique in which the developer is temporarily stored in a hopper and is supplied from the hopper into the developer tank in the image forming apparatus in order that supply of the developer from the cartridge into the developer tank may be stabilized. Such a technique as follows for detection of the developer in such a hopper has been proposed in Japanese Unexamined Utility Model Registration Application Publication No. 6-16964, for instance. Therein, cases having detection surfaces pervious to light and an optical sensor housed in the cases are provided in the hopper. The developer is detected by the optical sensor through the detection surfaces.

In Japanese Unexamined Utility Model Registration Application Publication No. 6-16964, a technique is further proposed in which the developer is removed from the detection surfaces by sliding of a cleaning unit including flexible members along the detection surfaces in order that deterioration in detection accuracy of the optical sensor due to deposition of the developer on the detection surfaces may be inhibited.

The developer, however, is prone to be deposited on the cleaning unit provided in the hopper. In case where a state in which the developer is deposited on the cleaning unit is left as it is for a long period, there is a fear that the developer may adhere onto the cleaning unit and that a function of the cleaning unit (function of removing the developer from the detection surfaces) may eventually deteriorate.

It is desirable to inhibit powder from being deposited on a cleaning unit in a powder detection device that detects the powder such as developer and a development device that includes such a powder detection device.

SUMMARY

A powder detection device according to the disclosure is a device that is provided in a storage container for powder and that detects the powder in the storage container and includes a detection unit, a cleaning unit, and a drive unit.

The detection unit includes detection surfaces provided in the storage container and enables detection of the powder through the detection surfaces. The cleaning unit removes the powder from the detection surfaces by sliding along the detection surfaces. The drive unit reciprocates the cleaning unit along a path extending through the detection surfaces and differentiates a speed at which the cleaning unit is moved in a first direction along the path from a speed at which the cleaning unit is moved in a second direction opposite to the first direction.

DESCRIPTION OF THE EMBODIMENTS

Hereinbelow, embodiments in which a powder detection device of the disclosure is applied to a development device an electrophotographic image forming apparatus includes will be described with reference to drawings. In the embodiments that will be described below, the powder detection device detects developer that is powder.

[1] First Embodiment

[1-1] Configurations of Image Forming Apparatus

Figure 1:
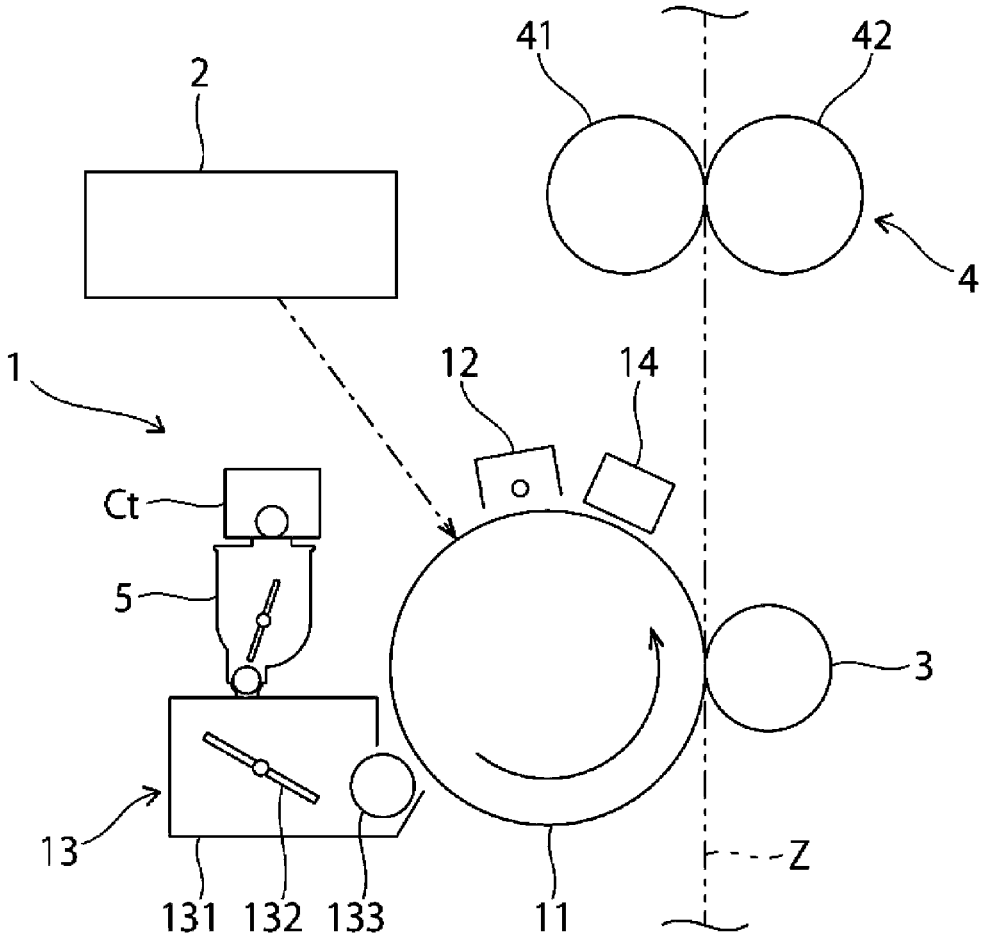
FIG. 1 is a conceptual diagram illustrating principal portions of an electrophotographic image forming apparatus.

As illustrated in FIG. 1, the image forming apparatus prints an image on a paper sheet Z by electrophotographic image forming processing based on image data. Specifically, the image forming apparatus of an embodiment is a monochrome image forming apparatus including a major process device 1, an exposing device 2, a transfer roller 3, and a fixation device 4 as principal portions. The image forming apparatus may be a color image forming apparatus that adopts a color space such as CMYK space. In this configuration, a plurality of major process devices 1 are provided in the image forming apparatus in accordance with the color space to be used.

The major process device 1 includes a photosensitive drum 11, a charging device 12, a development device 13, and a cleaning device 14. The photosensitive drum 11 is an electrostatic latent image carrier. The charging device 12 charges the photosensitive drum 11 so that a peripheral surface of the photosensitive drum 11 may have a specified potential. An electrostatic latent image in accordance with image data is formed on the peripheral surface of the charged photosensitive drum 11 by laser radiation from the charging device 12.

The development device 13 includes a developer tank 131, a stirring unit 132, a development roller 133, and a hopper 5. Developer is supplied from a cartridge Ct placed above the developer tank 131 through the hopper 5 into the developer tank 131. The developer is temporarily stored in the hopper 5 and is supplied from the hopper 5 into the developer tank 131 in order that supply of the developer from the cartridge Ct into the developer tank 131 may be stabilized. Storage of the developer in the hopper 5 makes it possible to continuously supply the developer into the developer tank 131 even in a state in which the cartridge Ct has temporarily been removed. Specific configurations of the hopper 5 will be described later.

The stirring unit 132 stirs the developer in the developer tank 131 and delivers the developer toward the development roller 133. In case where the developer contains nonmagnetic toner and magnetic carrier, friction between the nonmagnetic toner and the magnetic carrier is caused by a stir by the stirring unit 132 and the nonmagnetic toner is charged by the friction. Low-temperature fixing toner may be used as toner contained in the developer.

The development roller 133 draws up the developer from the developer tank 131 and delivers the developer to a developing position by rotation of the development roller 133. The development roller 133 transfers the toner, deposited on a peripheral surface of the development roller 133, to the developing position on the peripheral surface of the photosensitive drum 11. Thus the electrostatic latent image is developed, so that a toner image is formed. In case where the developer contains nonmagnetic toner and magnetic carrier, the nonmagnetic toner contained in the developer is used for development of the electrostatic latent image.

The formed toner image is delivered by rotation of the photosensitive drum 11 to a transfer position where transfer to the paper sheet Z is to be carried out and is transferred onto the paper sheet Z by the transfer roller 3 at the transfer position. Specifically, the transfer roller 3 generates electrostatic forces in the toner that forms the toner image by application of a bias to the transfer roller 3 and transfers the toner image onto the paper sheet Z by making use of the electrostatic forces.

After transferring the toner image, the cleaning device 14 removes the toner and other deposits (such as dust) remaining on the peripheral surface of the photosensitive drum 11. Thus preparation for subsequent image forming processing is made.

The fixation device 4 includes a heating roller 41 and a pressure roller 42 that is in pressure contact with the heating roller 41. The paper sheet Z onto which the toner image has been transferred is passed through between the heating roller 41 and the pressure roller 42 and moderate heat and a moderate pressure are thereby applied to the toner image. Thus the toner image is fixed onto the paper sheet Z.

[1-2] Configurations of Hopper

Figure 2:
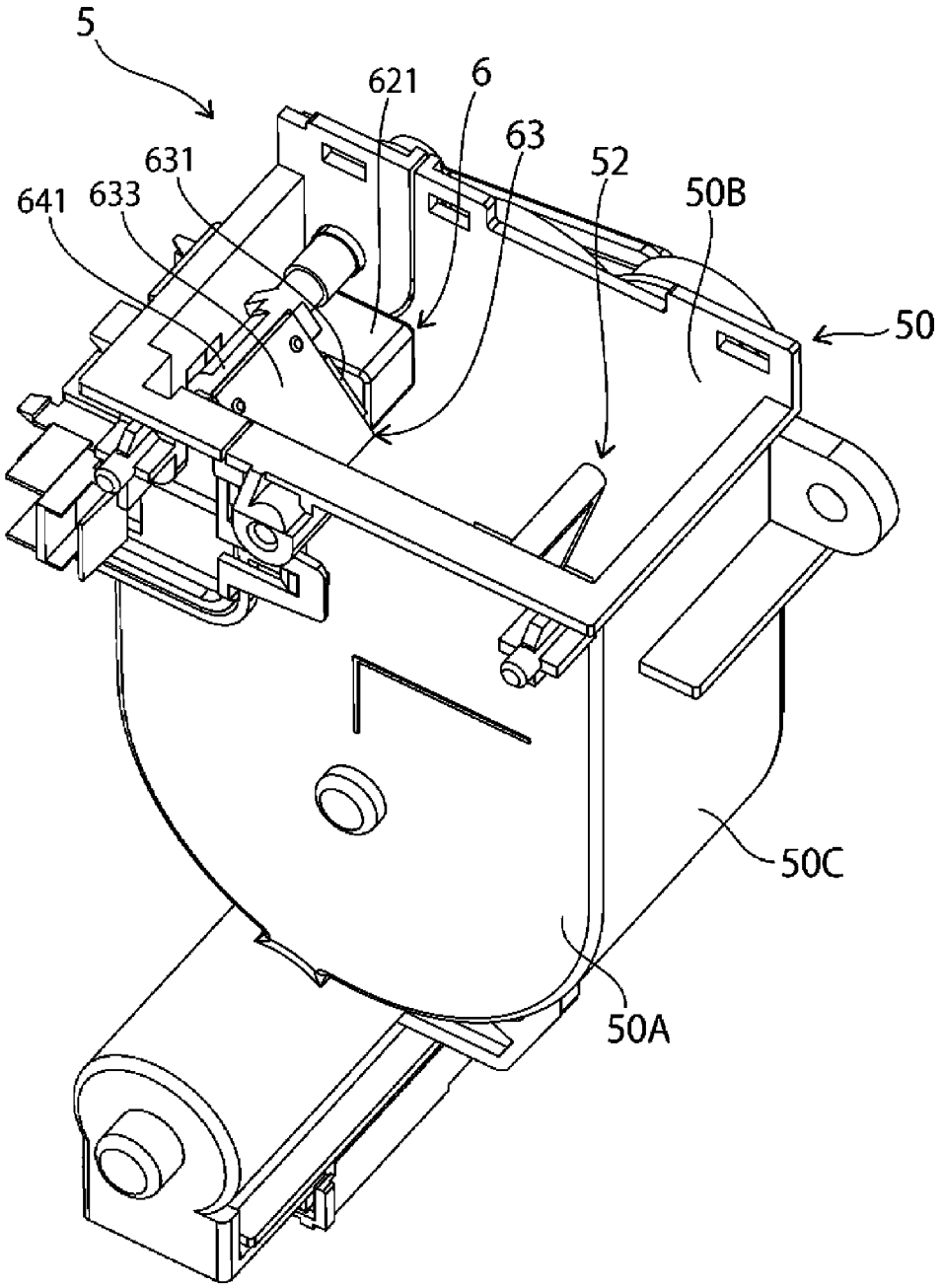
FIG. 2 is a perspective view that conceptually illustrates a hopper a development device according to a first embodiment includes, as seen looking from a front side.
Figure 3A:
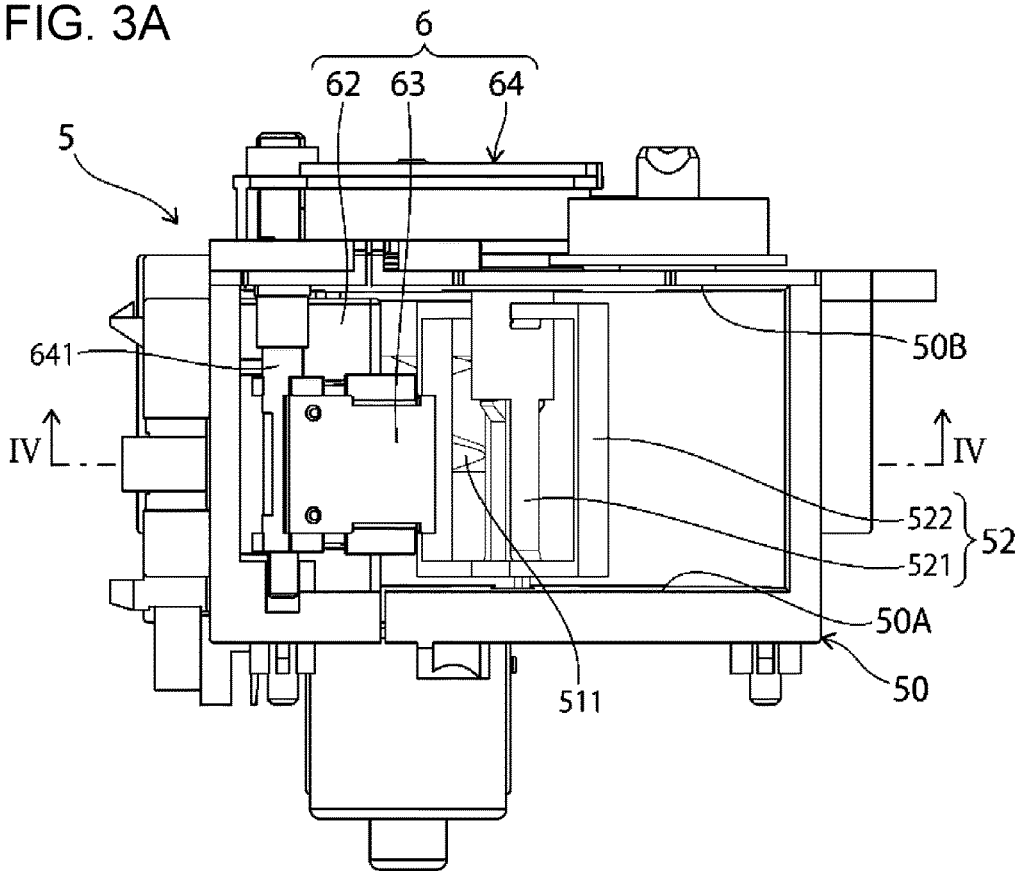
FIG. 3A is a top view of the hopper.
Figure 3B:
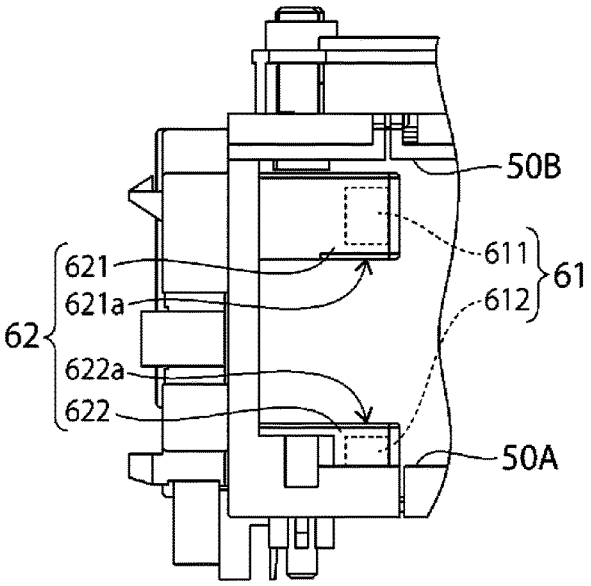
FIG. 3B is a top view focused on a detection unit a powder detection device includes.
Figure 3C:
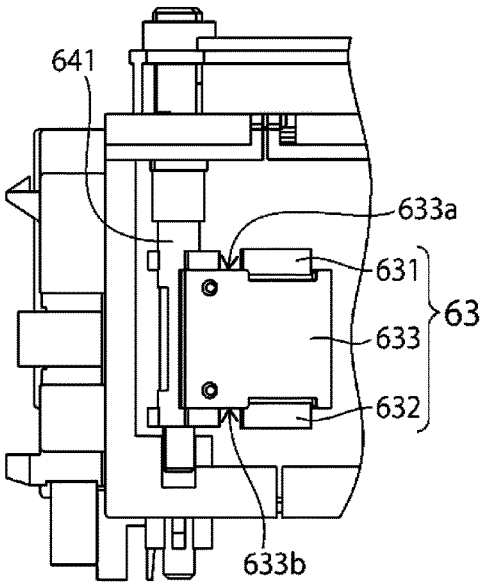
FIG. 3C is a top view focused on a cleaning unit the powder detection device includes.
Figure 4:
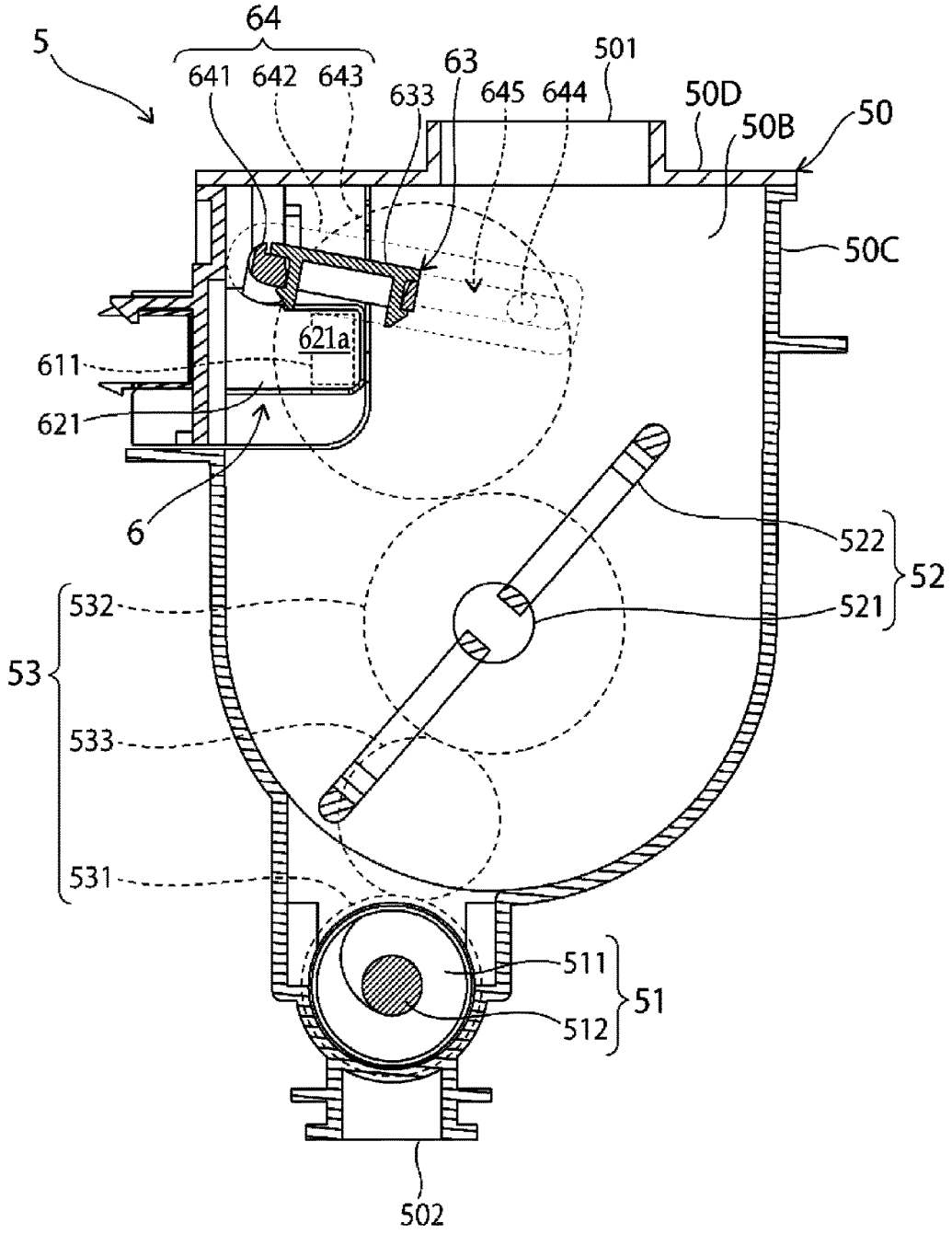
FIG. 4 is a sectional view taken along line IV-IV illustrated in FIG. 3A.

As illustrated in FIGS. 2 to 4, the hopper 5 includes a storage container 50 that stores the developer. The storage container 50 is made of a front wall 50A and a back wall 50B that face each other, a side wall 50C that links the front wall 50A and the back wall 50B and that is in shape of a letter U in section, and a top cover 50D. On a top portion (that is, the top cover 50D) of the storage container 50, an input port 501 through which the developer is inputted from the cartridge Ct placed above is provided. On a bottom portion (that is, a bottom of the side wall 50C) of the storage container 50, a discharge port 502 through which the developer is supplied into the developer tank 131 placed below is provided. In FIGS. 2 and 3A to 3C, the hopper 5 is illustrated with the top cover 50D removed.

As illustrated in FIGS. 2 to 4, the hopper 5 further includes a supply roller 51, a stirring vane 52, and a first drive unit 53. The hopper 5 is provided with a powder detection device 6 that detects the developer (powder) in the storage container 50. Specific configurations of the powder detection device 6 will be described later.

The supply roller 51 includes a delivery screw 511 placed in proximity of the discharge port 502 in the storage container 50 and a drive shaft 512 that rotates the delivery screw 511. By transmission of a rotational force through the drive shaft 512 to the delivery screw 511, the developer in the storage container 50 is discharged through the discharge port 502 and is supplied into the developer tank 131.

The stirring vane 52 includes a rotating shaft 521 that is rotatably supported by the front wall 50A and the back wall 50B and vane portions 522 that are fixed to the rotating shaft 521. The developer in the storage container 50 is stirred by transmission of a rotational force through the rotating shaft 521 to the vane portions 522.

Figure 5:
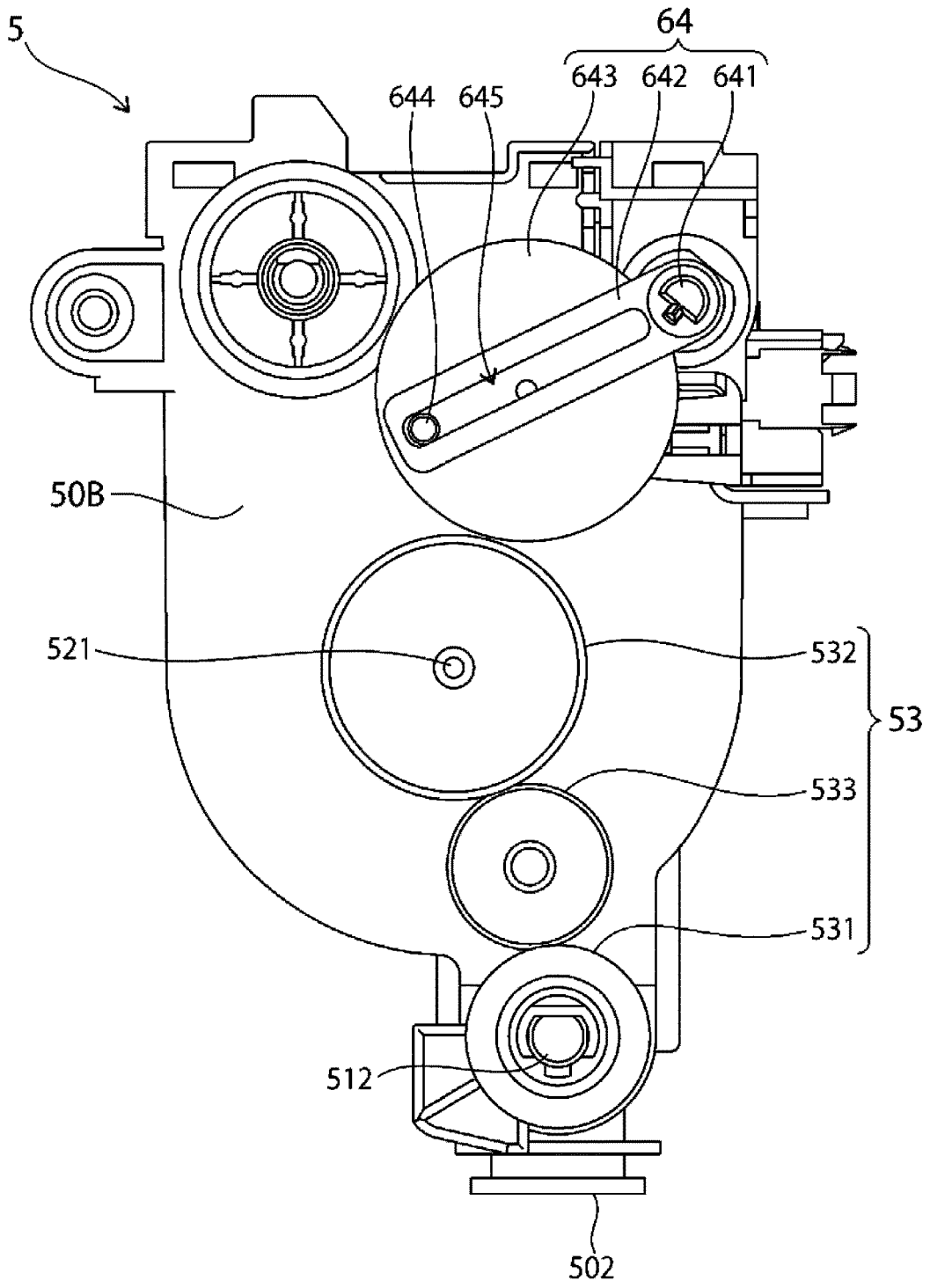
FIG. 5 is a back view of the hopper.

As illustrated in FIGS. 4 and 5, the first drive unit 53 includes three gears 531 to 533 provided on an outer surface of the back wall 50B. The gear 531 is fixed so that centers of rotation of the gear 531 and the drive shaft 512 coincide. The gear 532 is fixed so that centers of rotation of the gear 532 and the rotating shaft 521 coincide. The gear 533 transmits rotation of the gear 531 to the gear 532 and is axially supported by the back wall 50B so as to mesh with both the gears 531 and 532. By the first drive unit 53, rotation of the drive shaft 512 is transmitted through the three gears 531 to 533 to the stirring vane 52.

[1-3] Configurations of Powder Detection Device

As illustrated in FIGS. 2 to 4, the powder detection device 6 includes a detection unit 61, a housing unit 62, a cleaning unit 63, and a second drive unit 64. FIG. 3B is a top view focused on the detection unit 61 and the housing unit 62. FIG. 3C is a top view focused on the cleaning unit 63.

The detection unit 61 is an optical sensor made of a light emitting element 611 and a light receiving element 612 and is placed at a specified elevation in the storage container 50. The housing unit 62 includes a case 621 that houses the light emitting element 611 and a case 622 that houses the light receiving element 612.

The cases 621 and 622 respectively have detection surfaces 621*a* and 622*a* that are pervious to light from the light emitting element 611. The light emitting element 611 is housed in the case 621 with a light emitting surface of the light emitting element 611 directed toward the detection surface 621*a* and the light receiving element 612 is housed in the case 622 with a light receiving surface of the light receiving element 612 directed toward the detection surface 622*a*.

The cases 621 and 622 are placed so that the light emitting element 611 and the light receiving element 612 respectively have the specified elevation. Specifically, the cases 621 and 622 are placed as follows (see FIG. 3B). That is, the case 621 has the detection surface 621*a* directed toward the front wall 50A and the case 622 has the detection surface 622*a* directed toward the back wall 50B. In the cases 621 and 622, additionally, the detection surfaces 621*a* and 622*a* are made to face each other and are spaced apart from each other. Further, the cases 621 and 622 are placed so that light travelling from the light emitting element 611 to the light receiving element 612 may propagate at the specified elevation in a direction substantially perpendicular to the front wall 50A (or the back wall 50B).

Such placement of the cases 621 and 622 makes the light from the light emitting element 611 travel through the detection surface 621*a* toward the light receiving element 612 and makes it possible for the light receiving element 612 to detect the light from the light emitting element 611 through the detection surface 622*a*. When the developer in the storage container 50 reaches the specified elevation, the light travelling from the light emitting element 611 toward the light receiving element 612 is interrupted by the developer, so that the light is not detected by the light receiving element 612. When the developer in the storage container 50 falls short of the specified elevation, the light travelling from the light emitting element 611 toward the light receiving element 612 is detected by the light receiving element 612 without being interrupted by the developer.

Based on such results of detection by the light receiving element 612, it can be determined whether the developer in the storage container 50 reaches the specified elevation or not. Such determination is made by a control unit provided in the image forming apparatus, for instance. In other words, the detection unit 61 enables the detection of the developer through the detection surfaces 621*a* and 622*a*.

The cleaning unit 63 removes the developer from the detection surfaces 621*a* and 622*a* by sliding along the detection surfaces 621*a* and 622*a* and may include flexible members 631 and 632 and a holding portion 633. Nitrile rubber, urethane rubber, silicone rubber, or the like may be used as the flexible members 631 and 632.

The holding portion 633 holds the flexible members 631 and 632 with respect to a pivot shaft 641 and is fixed to the pivot shaft 641 so as to be capable of passing through between the detection surfaces 621*a* and 622*a* during pivoting of the pivot shaft 641. The pivot shaft 641 constituting the second drive unit 64 may pivotably be supported by the front wall 50A and the back wall 50B at positions in proximity of the cases 621 and 622. In the embodiment, the pivot shaft 641 is placed diagonally above the detection surfaces 621*a* and 622*a* (see FIG. 4). The pivot shaft 641 may be included in configurations of the cleaning unit 63.

In the embodiment, the holding portion 633 is a rectangular flat plate having a width smaller than a distance between the detection surfaces 621*a* and 622*a* and is fixed to the pivot shaft 641 with one side thereof extending along the pivot shaft 641. Accordingly, the holding portion 633 has an edge 633*a* that can face the detection surface 621*a* and an edge 633*b* that can face the detection surface 622*a* (see FIG. 3C).

The flexible members 631 and 632 are respectively attached to the edges 633*a* and 633*b* of the holding portion 633. The flexible member 631 slides in a pressure contact state (warped state) on the detection surface 621*a*, when the flexible member 631 passes by the detection surface 621*a*, and has a shape and a size that allow such sliding. The flexible member 632 slides in a pressure contact state (warped state) on the detection surface 622*a*, when the flexible member 632 passes by the detection surface 622*a*, and has a shape and a size that allow such sliding. In the embodiment, the shapes and sizes of the flexible members 631 and 632 are set so that end edges of the flexible members 631 and 632 may respectively come into line contact or surface contact with the detection surfaces 621*a* and 622*a*.

As illustrated in FIGS. 4 and 5, the second drive unit 64 includes a mechanism that reciprocates the cleaning unit 63 along the path extending through the detection surfaces 621*a* and 622*a*. Specifically, the second drive unit 64 may include the above-described pivot shaft 641, an arm portion 642, and a rotating plate 643.

The arm portion 642 is placed along the outer surface of the back wall 50B. Specifically, the arm portion 642 may be connected to the pivot shaft 641 outside the storage container 50 and may extend substantially perpendicularly to the pivot shaft 641. In the embodiment, a direction in which the arm portion 642 extends from the pivot shaft 641 substantially coincides with a direction in which the cleaning unit 63 (principally, the holding portion 633) extends from the pivot shaft 641, as seen looking in a direction in which the pivot shaft 641 extends (see FIG. 4). Therefore, a posture of the cleaning unit 63 around the pivot shaft 641 changes in accordance with a posture of the arm portion 642 around the pivot shaft 641.

The rotating plate 643 is a gear provided on the outer surface of the back wall 50B. The rotating plate 643 is axially supported by the back wall 50B so that a center of the rotating plate 643 may be at a position different from a center of the pivot shaft 641. In addition, the rotating plate 643 is axially supported by the back wall 50B so as to lie over the detection surfaces 621*a* and 622*a*, as seen looking in the direction in which the pivot shaft 641 extends (see FIG. 4), and so as to mesh with the gear 532. Thus the rotation of the drive shaft 512 is transmitted through the three gears 531 to 533 to the rotating plate 643.

On the rotating plate 643, an engaging portion 644 may be protruded at a position different from the center of the rotating plate 643. In the embodiment, the engaging portion 644 is such a protrusion as a pin. The engaging portion 644 revolves about the center of the rotating plate 643 with rotation of the rotating plate 643.

On the arm portion 642, an engagement receiving portion 645 may be opened, the engagement receiving portion 645 which extends in the direction of extension of the arm portion 642 and with which the engaging portion 644 slidably engages. In the embodiment, the engagement receiving portion 645 is a through hole, in shape of a slit, formed on the arm portion 642. The engagement receiving portion 645 is provided in an appropriate length on the arm portion 642 so as not to obstruct the rotation of the rotating plate 643 (that is, so that the engaging portion 644 may not collide with ends of the engagement receiving portion 645 during the rotation of the rotating plate 643). Without limitation thereto, the engagement receiving portion 645 may be a recessed groove on the arm portion 642.

According to the above-described configuration of the second drive unit 64, such operations as the following of the arm portion 642 are carried out (see FIGS. 6A to 6C and 7A to 7C). In back view, a line that coincides with a center line L1 of the arm portion 642 (line extending through the center of the pivot shaft 641 in the direction of extension of the arm portion 642) when the center line L1 passes through the center of the rotating plate 643 is defined as a reference line L0. An angle the center line L1 of the arm portion 642 makes with the reference line L0 is defined as a slope angle θ of the center line L1.

With the rotation of the rotating plate 643, the engaging portion 644 slides in the engagement receiving portion 645 while revolving about the center of the rotating plate 643. Thus the arm portion 642 changes the slope angle θ of the center line L1 in accordance with the position of the engaging portion 644 about the center of the rotating plate 643.

Figure 6A:
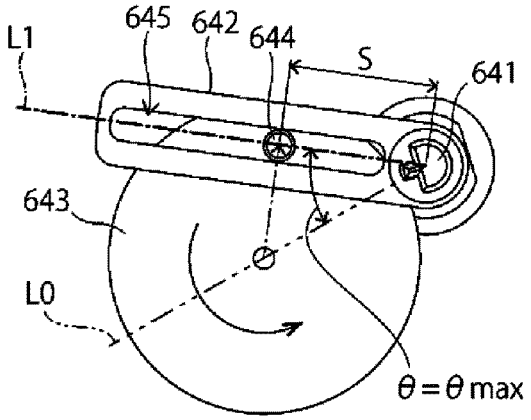
FIGS. 6A to 6C are diagrams in which an operation of an arm portion in a lowering period is sequentially illustrated as FIGS. 6A, 6B, and 6C, in order of mention.
Figure 6B:
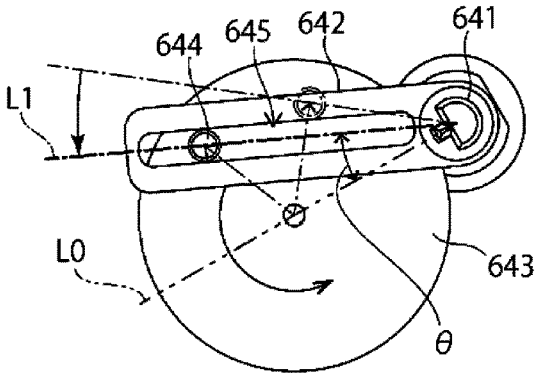
Figure 6C:
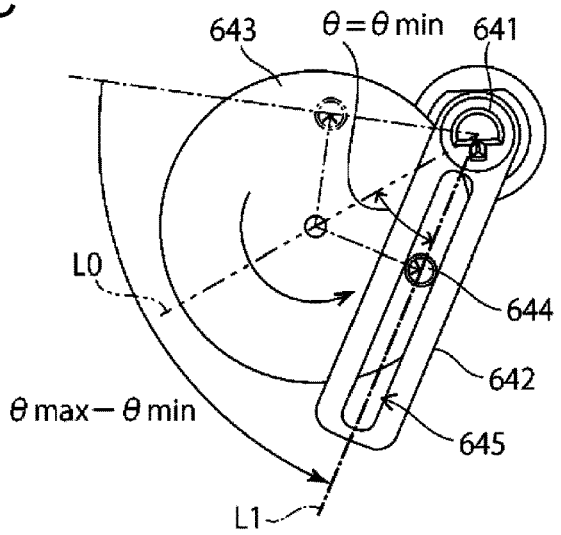
Figure 7A:
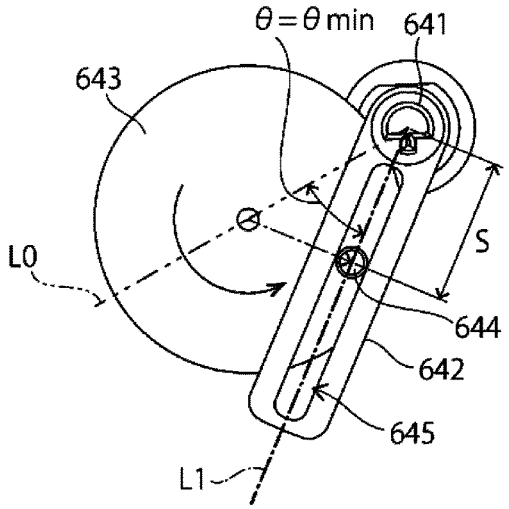
FIGS. 7A to 7C are diagrams in which an operation of the arm portion in a raising period is sequentially illustrated as FIGS. 7A, 7B, and 7C, in order of mention.
Figure 7B:
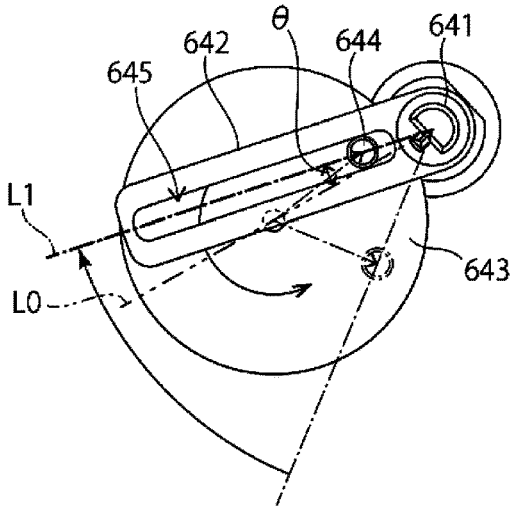
Figure 7C:
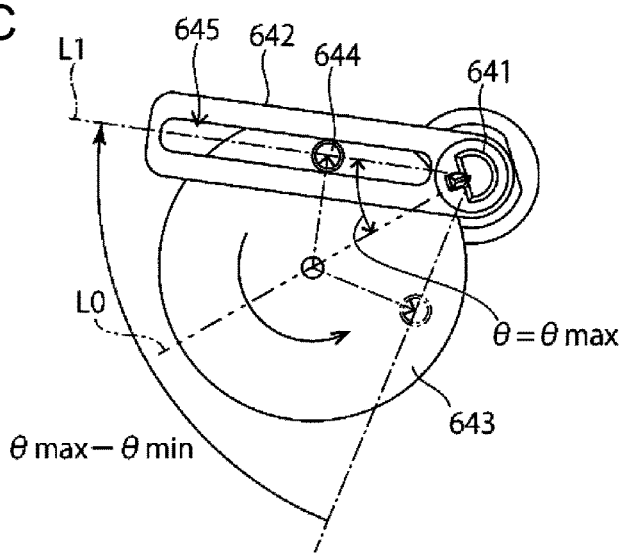

As a result, the arm portion 642 changes the posture thereof in accordance with the slope angle θ between the posture (see FIGS. 6A and 7C) that makes the slope angle θ reach a maximum value θmax and the posture (see FIGS. 6C and 7A) that makes the slope angle θ reach a minimum value θmin (see FIGS. 6B and 7B). That is, the arm portion 642 pivots on the center of the pivot shaft 641 within a specified angle range (θmax−θmin).

In the embodiment, the posture of the arm portion 642 changes between a first posture (see FIGS. 6A and 7C) in which the arm portion 642 is raised so that the center line L1 is made substantially horizontal and a second posture (see FIGS. 6C and 7A) in which the arm portion 642 is lowered so that the center line L1 is directed downward. In the first posture, in which the slope angle θ reaches the maximum value θmax, the center line L1 is made tangent to a revolving path of the engaging portion 644 at an upper position. In the second posture, in which the slope angle θ reaches the minimum value θmin, the center line L1 is made tangent to the revolving path of the engaging portion 644 at a lower position.

In one rotation of the rotating plate 643, accordingly, a lowering period (see FIGS. 6A to 6C) in which the arm portion 642 is lowered from the first posture to the second posture and a raising period (see FIGS. 7A to 7C) in which the arm portion 642 is raised from the second posture to the first posture are included. That is, while the rotating plate 643 makes one rotation, the pivot shaft 641 forwardly rotates corresponding to the lowering period for the arm portion 642 and reversely rotates corresponding to the raising period for the arm portion 642.

According to the above-described configuration of the second drive unit 64, furthermore, a variation in the angle of the arm portion 642 with respect to a travelling distance of the engaging portion 644 in a first period (see FIGS. 7A to 7C) in which a distance S from the center of the pivot shaft 641 to the engaging portion 644 is small is greater than the variation in a second period (see FIGS. 6A to 6C) in which the distance S is large. Herein, the first period in which the distance S is small is a period in which the distance S gradually decreases to a minimum value and in which the distance S thereafter gradually increases from the minimum value. Similarly, the second period in which the distance S is large is a period in which the distance S gradually increases to a maximum value and in which the distance S thereafter gradually decreases from the maximum value.

Accordingly, a rotational speed of the arm portion 642 is higher in the first period than in the second period. That is, a rotational speed of the pivot shaft 641 is higher in the first period than in the second period. As a result, a travelling speed of the cleaning unit 63 held by the pivot shaft 641 changes correspondingly to pivoting of the arm portion 642.

In the embodiment, the lowering period for the arm portion 642 corresponds to the second period in which the distance S is large and the raising period for the arm portion 642 corresponds to the first period in which the distance S is small. Accordingly, the rotational speed of the arm portion 642 in the raising period exceeds the rotational speed of the arm portion 642 in the lowering period and the travelling speed of the cleaning unit 63 being raised correspondingly becomes higher. That is, the travelling speed of the cleaning unit 63 being raised along the path is higher than the travelling speed of the cleaning unit 63 being lowered along the path.

Thus the second drive unit 64 differentiates the travelling speed of the cleaning unit 63 being lowered along the path from the travelling speed of the cleaning unit 63 being raised along the path. In the embodiment, a direction in which the cleaning unit 63 is lowered along the path corresponds to the "first direction" according to the claims and a direction in which the cleaning unit 63 is raised along the path corresponds to the "second direction" according to the claims.

According to the powder detection device 6, the travelling speed of the cleaning unit 63 changes correspondingly to the direction in which the cleaning unit 63 is moved. Such change in the travelling speed of the cleaning unit 63 enables shaking off powder deposited on the cleaning unit 63. Thus a state in which the developer is deposited on the cleaning unit 63 is inhibited from being left as it is for a long period and a function of the cleaning unit 63 (function of removing the developer from the detection surfaces 621*a* and 622*a*) can consequently be maintained for a long period.

[2] Second Embodiment

Figure 8:
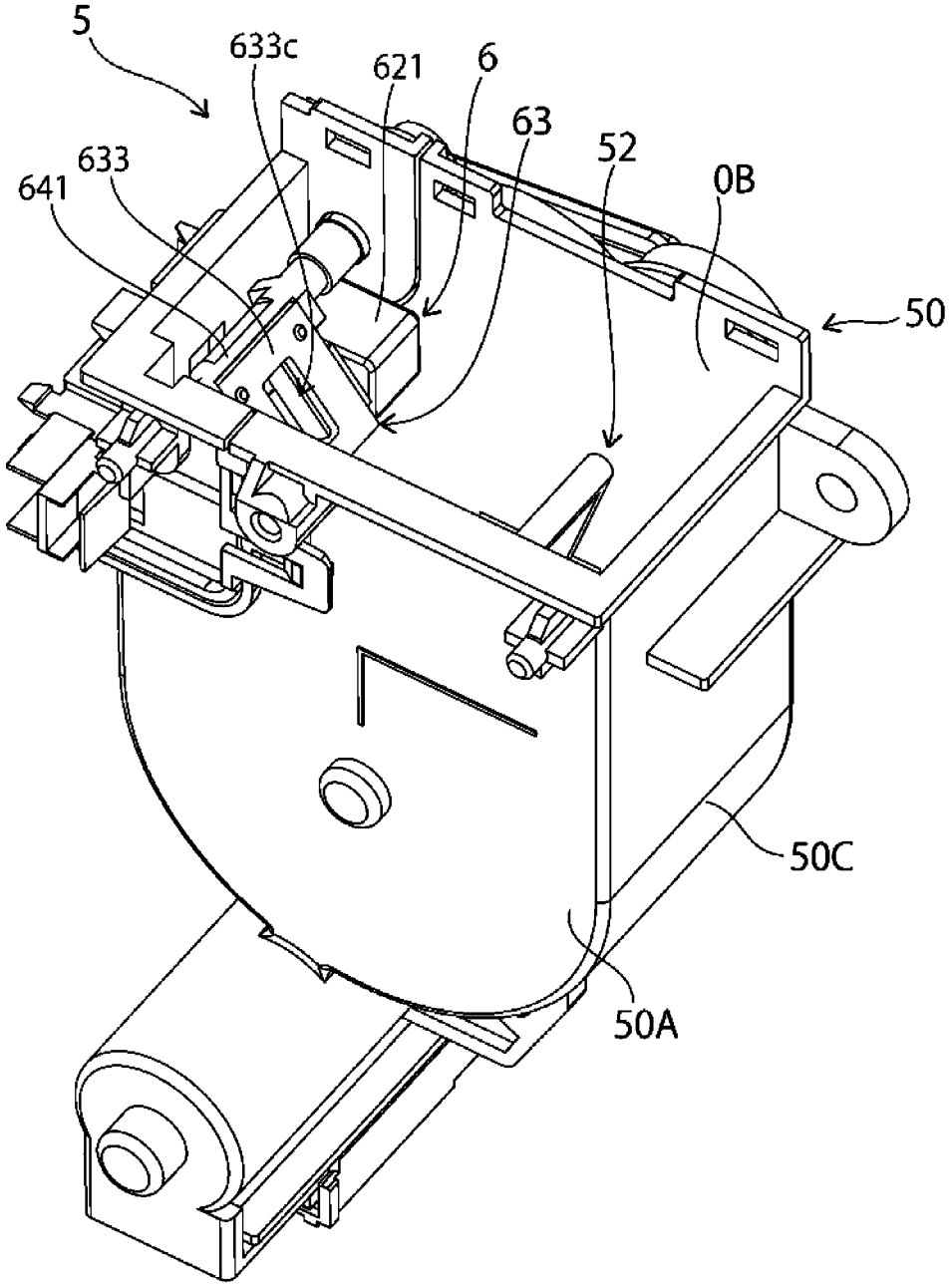
FIG. 8 is a perspective view that conceptually illustrates a hopper a development device according to a second embodiment includes, as seen looking from a front side.

As illustrated in FIG. 8, the holding portion 633 may be provided with an opening 633*c* that penetrates the holding portion 633. This configuration decreases a surface area of the holding portion 633. Accordingly, a mass of deposit of the developer on the holding portion 633 can be reduced. Besides, the developer can be passed through the opening 633*c*. Thus a load on the cleaning unit 63 is reduced even if the cleaning unit 63 comes into contact with the developer in the storage container 50 when the cleaning unit 63 is moved.

Without limitation to the powder detection device 6 including the second drive unit 64 and described as the first embodiment, the configuration of the holding portion 633 may be applied to various powder detection devices including other drive mechanisms.

[3] Third Embodiment

Figure 9A:
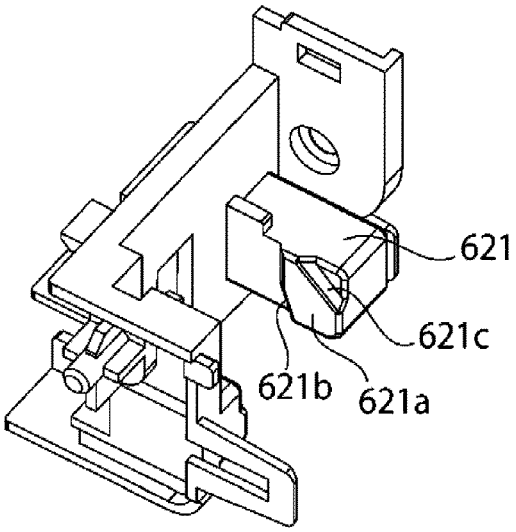
FIG. 9A is a perspective view of a detection unit in a development device according to a third embodiment.
Figure 9B:
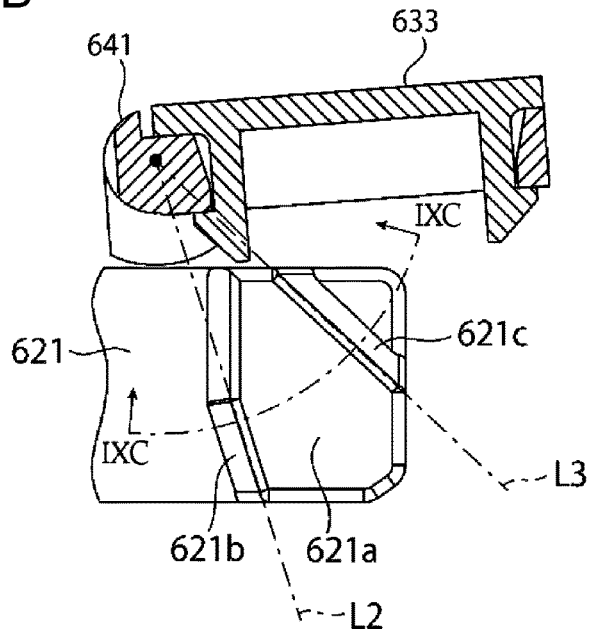
FIG. 9B is a front view of a detection surface in the same.
Figure 9C:
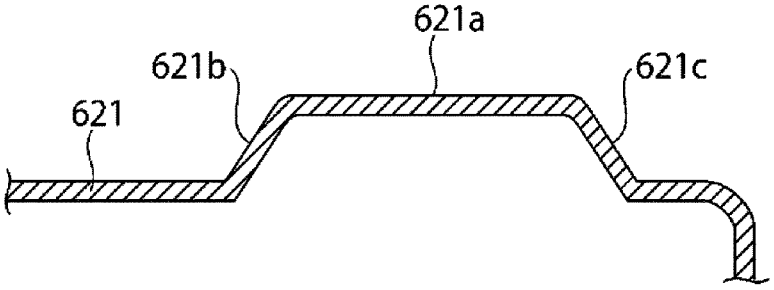
FIG. 9C is a sectional view taken along line IXC-IXC illustrated in FIG. 9B.

As illustrated in FIGS. 9A to 9C, two sloped surfaces 621*b* and 621*c* may respectively be provided on both sides of and adjacent to the detection surface 621*a* in a path along which the flexible member 631 moves. Along the sloped surfaces 621*b* and 621*c*, specifically, regions on the case 621 on both the sides of the detection surface 621*a* are made to recede toward the back wall 50B so as not to come into contact with the flexible member 631 (or so as to decrease a load on the flexible member 631 if coming into contact therewith). That is, the sloped surfaces 621*b* and 621*c* may flex the flexible member 631 and may bring the flexible member 631 into the pressure contact state when the flexible member 631 moves onto the detection surface 621*a* through the sloped surfaces 621*b* and 621*c*. Similar sloped surface may be provided on both sides of the detection surface 622*a*.

When the flexible member 631 moves onto the detection surface 621*a* through the sloped surface 621*b* or 621*c*, according to this configuration, the flexible member 631 is flexed gradually from the end edge thereof by the sloped surface 621*b* or 621*c*. On the detection surface 621*a*, consequently, the flexible member 631 is brought into a state in which the end edge part is trailed rearward with respect to a travelling direction. The state enhances a function (capability to scrape off the developer) of the flexible member 631. The same applies to the flexible member 632.

In the embodiment, furthermore, the sloped surfaces 621*b* and 621*c* are respectively formed along phantom lines L2 and L3 extending through the center of the pivot shaft 641 in front view (or back view) as illustrated in FIG. 9B in order that the flexible member 631 may be inhibited from being warped when passing through the sloped surfaces 621*b* and 621*c*.

Only either one of the sloped surfaces 621*b* and 621*c* may be provided on one side of the detection surface 621*a* in the path along which the flexible member 631 moves. In a path along which the flexible member 632 moves, similarly, a sloped surface may be provided on only one side of the detection surface 622*a*.

Without limitation to the powder detection device 6 including the second drive unit 64 and described as the first embodiment, the configuration of the detection surfaces 621*a* and 622*a* may be applied to various powder detection devices including other drive mechanisms.

[4] Fourth Embodiment

Figure 10A:
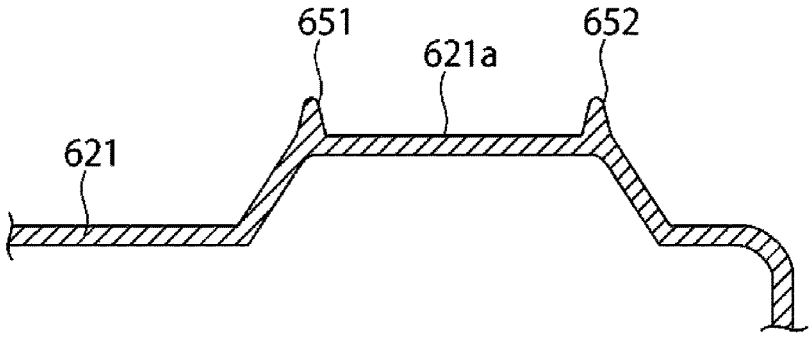
FIGS. 10A and 10B are sectional views of a detection surface in a development device according to a fourth embodiment.

As illustrated in FIG. 10A, protruding portions 651 and 652 may be provided on the detection surface 621*a* so that the flexible member 631 may come into contact with the protruding portions 651 and 652 when the cleaning unit 63 passes thereby. The protruding portions 651 and 652 are desirably formed on both ends (see FIG. 9B) of the detection surface 621*a* with respect to a direction in which the flexible member 631 travels. Similar protruding portions may be provided on the detection surface 622*a*.

According to this configuration, the end edge part of the flexible member 631 is caught by the protruding portion 651 when the flexible member 631 passes by the protruding portion 651 and the end edge part is flicked by the protruding portion 651 when the flexible member 631 further moves. The same applies when the flexible member 631 passes by the protruding portion 652. The developer deposited on the flexible member 631 is shaken off by impact produced then in the flexible member 631. The same applies to the flexible member 632.

Figure 10B:
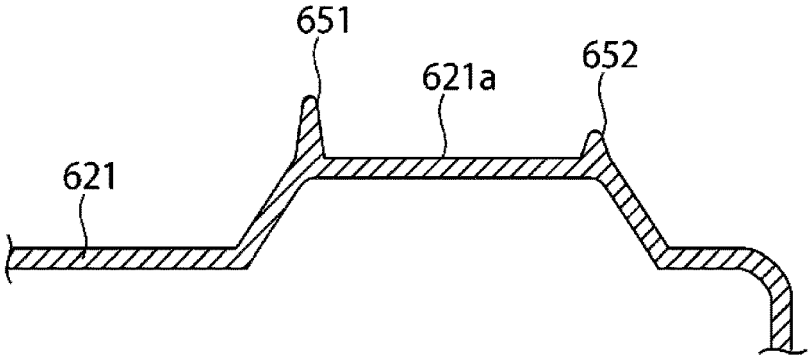

In the embodiment, furthermore, the protruding portions 651 and 652 that differ in height may be used as illustrated in FIG. 10B.

Only either one of the protruding portions 651 and 652 may be provided on the detection surface 621*a*. Specifically, a height of the protruding portion with which the cleaning unit 63 initially comes into contact when being lowered may be made different from a height of the protruding portion with which the cleaning unit 63 initially comes into contact when being raised. The same applies to the detection surface 622*a*.

Without limitation to the powder detection device 6 including the second drive unit 64 and described as the first embodiment, the configuration of the detection surfaces 621*a* and 622*a* may be applied to various powder detection devices including other drive mechanisms.

[5] Fifth Embodiment

Figure 11:
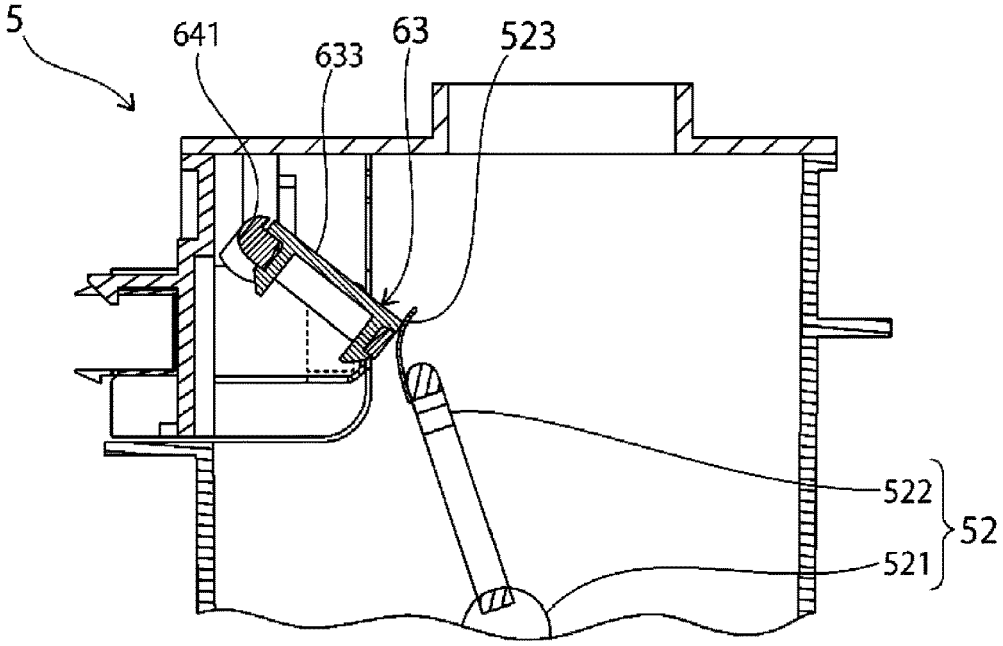
FIG. 11 is a fragmentary sectional view of a hopper a development device according to a fifth embodiment includes.

As illustrated in FIG. 11, sweeping parts 523 made with use of PET films or the like may be provided on end edges of the vane parts 522 of the stirring vane 52. Herein, the sweeping parts 523 come into contact with the cleaning unit 63 with rotation of the stirring vane 52 and thereby sweep the developer deposited on the cleaning unit 63. According to this configuration, deposition of the developer on the cleaning unit 63 can be inhibited with use of the stirring vane 52.

[6] Other Embodiments

In the powder detection device 6, the rotating plate 643 may reversely be rotated by interposition of another gear between the rotating plate 643 and the gear 532, for instance. Thus the travelling speed of the cleaning unit 63 being lowered along the path may be higher than the travelling speed of the cleaning unit 63 being raised along the path.

In the powder detection device 6, an amount of pivoting and rotation of the pivot shaft 641 may be controlled by a control unit provided in the image forming apparatus. The second drive unit 64 may include a speed variation mechanism for the gears.

Furthermore, the configurations of the portions and the units of the powder detection device 6 may be applied to various devices that handle powder without limitation to the development device 13.

It is to be understood that above description on the embodiments is not limitative but exemplary in all respects. The scope of the disclosure is not defined by the embodiments described above but is defined by the appended claims. Further, it is intended that the scope of the disclosure includes equivalents of the claims and all modifications within the scope.

The present disclosure contains subject matter related to that disclosed in Japanese Priority Patent Application JP 2016-081616 filed in the Japan Patent Office on Apr. 15, 2016, the entire contents of which are hereby incorporated by reference.

What is claimed is:

1. A powder detection device that is provided in a storage container for powder and that detects the powder in the storage container, the powder detection device comprising:

a detection unit that includes a detection surface provided in the storage container and that detects the powder through the detection surface;

a cleaning unit that removes the powder from the detection surface by sliding along the detection surface; and a drive unit that reciprocates the cleaning unit, wherein the drive unit includes a pivot shaft that is axially supported by the storage container, the cleaning unit is held by the pivot shaft, and is provided with an opening, and the cleaning unit pivots on center of the pivot shaft.

2. The powder detection device according to claim 1, wherein the pivot shaft is arranged perpendicularly to the detection surface, and the cleaning unit reciprocates about the pivot shaft.

3. The powder detection device according to claim 2, wherein the drive unit changes a speed at which the cleaning unit is moved in response to a direction in which the cleaning unit is moved about the pivot shaft.

4. The powder detection device according to claim 2, wherein the cleaning unit includes a flexible member that slides on the detection surface, and a holding portion that holds the flexible member with respect to the pivot shaft, and the holding portion is provided with the opening.

5. The powder detection device according to claim 4, wherein the detection surface includes two detection surfaces facing each other, the cleaning unit reciprocates through the space between the two detection surfaces, the holding portion has two edges that can respectively face the two detection surfaces when the cleaning unit reciprocates, and the flexible member is attached to each of the two edges.

6. The powder detection device according to claim 5, wherein the opening has a rectangular shape with two sides along the two edges.

7. The powder detection device according to claim 1, wherein the cleaning unit includes a flexible member that slides on the detection surface, and the detection unit further includes a sloped surface adjacent to the detection surface, and the sloped surface flexes the flexible member when the flexible member moves onto the detection surface.

8. The powder detection device according to claim 1, wherein the cleaning unit includes a flexible member that slides on the detection surface, and a protruding portion with which the flexible member comes into contact when the cleaning unit passes by the detection surface is provided on the detection surface.

9. A development device comprising:

a storage container that stores developer;

a developer tank into which the developer is supplied from the storage container; and the powder detection device according to claim 1 applied to detection of the developer in the storage container.

10. A powder detection device that is provided in a storage container for powder and that detects the powder in the storage container, the powder detection device comprising:

a detection unit that includes a detection surface provided in the storage container and that detects the powder through the detection surface;

a cleaning unit that removes the powder from the detection surface by sliding along the detection surface; and a drive unit that reciprocates the cleaning unit, wherein the drive unit includes a pivot shaft that is supported by the storage container, the cleaning unit is held by the pivot shaft, the cleaning unit includes a flexible member that slides on the detection surface, and a holding portion that holds the flexible member with respect to the pivot shaft, and the holding portion is provided with an opening.

11. The powder detection device according to claim 10, wherein the pivot shaft is arranged perpendicularly to the detection surface, and the cleaning unit reciprocates about the pivot shaft.

12. The powder detection device according to claim 11, wherein the drive unit changes a speed at which the cleaning unit is moved in response to a direction in which the cleaning unit is moved about the pivot shaft.

13. The powder detection device according to claim 10, wherein the detection surface includes two detection surfaces facing each other, the cleaning unit reciprocates through the space between the two detection surfaces, the holding portion has two edges that can respectively face the two detection surfaces when the cleaning unit reciprocates, and the flexible member is attached to each of the two edges.

14. The powder detection device according to claim 13, wherein the opening has a rectangular shape with two sides along the two edges.

15. The powder detection device according to claim 10, wherein the detection unit further includes a sloped surface adjacent to the detection surface, and the sloped surface flexes the flexible member when the flexible member moves onto the detection surface.

16. The powder detection device according to claim 10, wherein a protruding portion with which the flexible member comes into contact when the cleaning unit passes by the detection surface is provided on the detection surface.

17. A development device comprising:

a storage container that stores developer;

a developer tank into which the developer is supplied from the storage container; and the powder detection device according to claim 10 applied to detection of the developer in the storage container.

* * * * *